US009567783B2

(12) United States Patent
Ala

(10) Patent No.: US 9,567,783 B2
(45) Date of Patent: Feb. 14, 2017

(54) SELF-RESETTABLE DOOR LOCKING DEVICE FOR AN ELECTRIC HOUSEHOLD APPLIANCE, IN PARTICULAR A DISHWASHER

(75) Inventor: Gianbattista Ala, Volpiano (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1266 days.

(21) Appl. No.: 13/386,279

(22) PCT Filed: Jul. 22, 2010

(86) PCT No.: PCT/US2010/042874

§ 371 (c)(1),
(2), (4) Date: Jan. 20, 2012

(87) PCT Pub. No.: WO2011/011585

PCT Pub. Date: Jan. 27, 2011

(65) Prior Publication Data

US 2012/0126552 A1 May 24, 2012

(30) Foreign Application Priority Data

Jul. 23, 2009 (IT) ..... TO2009A0560

(51) Int. Cl.
*E05C 3/14* (2006.01)
*E05C 19/02* (2006.01)
(Continued)

(52) U.S. Cl.
CPC ..... *E05C 19/024* (2013.01); *E05B 2015/0493* (2013.01); *E05C 2005/005* (2013.01); *Y10T 292/1061* (2015.04)

(58) Field of Classification Search
USPC ..... 292/228, 219, 225, 216, DIG. 61, DIG. 69,292/DIG. 4
See application file for complete search history.

(56) References Cited

U.S. PATENT DOCUMENTS 2,558,233 A 6/1951 Burke
2,833,578 A 5/1958 Burke
(Continued)

FOREIGN PATENT DOCUMENTS

CN 1827995 A 9/2006
DE 1127748 B 4/1962
(Continued)

OTHER PUBLICATIONS

Search Reports for Italian Patent Application No. TO2009A000560 dated Mar. 24, 2010.
ISR for PCT/US2010/042874 dated Sep. 7, 2010.

*Primary Examiner* — Mark Williams
(74) *Attorney, Agent, or Firm* — Hauptman Ham, LLP

(57) ABSTRACT

A door locking device for an electric household appliance, in particular a dishwasher, including a first supporting body, a latch pivotally carried by the first supporting body about a first rotation axis and operatively associated in use with a door catch of the electric household appliance and elastic means carried by the first supporting body and secured between the latter and the latch to be adapted in use to make the latch selectively take first and second working positions, rotated to each other by a first angle about the first axis; wherein a second supporting body designed to be integrally carried in use by a door of the electric household appliance supports the first body overhangingly hinged on opposite side of the latch, second elastic means being interposed between the first and the second supporting bodies, which means are adapted to allow the same to rotate relatively about a second axis parallel to the first and eccentric with respect to the latch, at least by a second angle.

30 Claims, 3 Drawing Sheets

(51) Int. Cl.
*E05B 15/04* (2006.01)
*E05C 5/00* (2006.01)

(56) References Cited

U.S. PATENT DOCUMENTS

| | | | | |
|---|---|---|---|---|
| 6,290,270 | B1 * | 9/2001 | Spiessl | 292/226 |
| 6,390,518 | B1 * | 5/2002 | Elick | 292/216 |
| 6,913,296 | B2 | 7/2005 | Bassi | |
| 2006/0033346 | A1 | 2/2006 | Ala | |

FOREIGN PATENT DOCUMENTS

| | | | |
|---|---|---|---|
| DE | 19540843 | A1 | 5/1997 |
| DE | 102007033451 | A1 | 1/2009 |

* cited by examiner

SELF-RESETTABLE DOOR LOCKING DEVICE FOR AN ELECTRIC HOUSEHOLD APPLIANCE, IN PARTICULAR A DISHWASHER

RELATED APPLICATIONS

The present application is national phase of PCT/US2010/042874 filed Jul. 22, 2010, and claims priority from Italian Application Number TO2009A000560 filed Jul. 23, 2009.

TECHNICAL FIELD

The present invention relates to a self-resettable door locking device for an electric household appliance, in particular a dishwasher.

BACKGROUND ART

"Self-resettable" means a door locking device which allows the user to close the door of the dishwasher also when, for any reason, the latch is already in the working position, corresponding to the position of door locked, and then to obtain the locking of the door in the closed position.

A door locking device for a dishwasher is known from DE102007033451, for example, in which the door catch carried by the frame of the electric household appliance couples with a rotational latch carried by a supporting body, in turn positionable in use on the door of the electric household appliance, and in which, under certain conditions, transferring the door catch to the rotation member is prevented. This device is however very complex and bulky.

DISCLOSURE OF INVENTION

It is an object of the present invention to provide a self-resettable door locking device for an electric household appliance, in particular a dishwasher, which is constructionally simple and cost-effective, small in size and very reliable, and in which the self-resetting function does not interfere with the normal operation of the device itself.

The present invention thus relates to a self-resettable door locking device for an electric household appliance, in particular a dishwasher, as defined in claim 1.

In particular, the door locking device according to the invention comprises a first supporting body, a latch pivotally carried by the first supporting body about a first rotation axis and operatively associated in use with a door catch of the electric household appliance and first elastic means secured to and interposed between the first supporting body and the latch to be adapted in use to make the latch selectively take first and second working positions, rotated to each other by a first angle about the first axis, in which the door, when in the closed position, is respectively locked/released.

According to an aspect of the invention, the door locking device further comprises: a second supporting body designed to be integrally carried in use by a door of the electric household appliance and which movably supports the first body; and second elastic means carried by the second body and interposed between the latter and the first body.

The first body is normally kept by the second elastic means in a first working position, in which a tooth of the latch is adapted to intercept/not intercept in use the door catch when the latch is in the first and second working positions, respectively, to therefore lock/release the door when it is in a closed position.

The first body is further movable against the bias of the second elastic means towards a second working position, in which the tooth of the latch is no longer adapted to intercept in use the door catch when the latch is in the first working position.

In particular, a first side of the tooth of the latch, facing the second body, is shaped so that upon a movement of the door towards the closed position and when the latch is in the first working position, the latch exerts such a thrust on the first body, upon the interception of the door catch by the first side of the latch tooth, that it takes the first body to the second working position, against the bias of the second elastic means and without stressing the first elastic means, so that the latch may pass the door catch and allow the door to reach the closed position.

In this position, the door catch is beyond a second side of the tooth of the latch, facing the side opposite to the second body and shaped so that the second elastic means may return the first body to the first working position.

Thereby, under normal conditions, the device works exactly like the known, non-self-resettable devices. If, when the door is open, the latch is taken to the configuration that it should take when the door is closed, however, closing the door is not prevented, as it would occur in the known non-self-resettable devices, but the closing movement of the door simply causes the rotation of the first body with respect to the second, thus allowing the latch to engage the door catch, allowing the door to close and then taking the door/door catch/latch assembly to a normal closing and locking configuration.

As compared to other known self-resettable devices, however, the device according to the invention is smaller in size and constructionally simpler, in addition to being more reliable in operation.

BRIEF DESCRIPTION OF THE DRAWINGS

Further features and advantages of the present invention will be apparent from the following description of a preferred embodiment thereof, merely provided by way of non-limitative example, with reference to the accompanying drawings, in which.

BEST MODE FOR CARRYING OUT THE INVENTION

Figure 1:
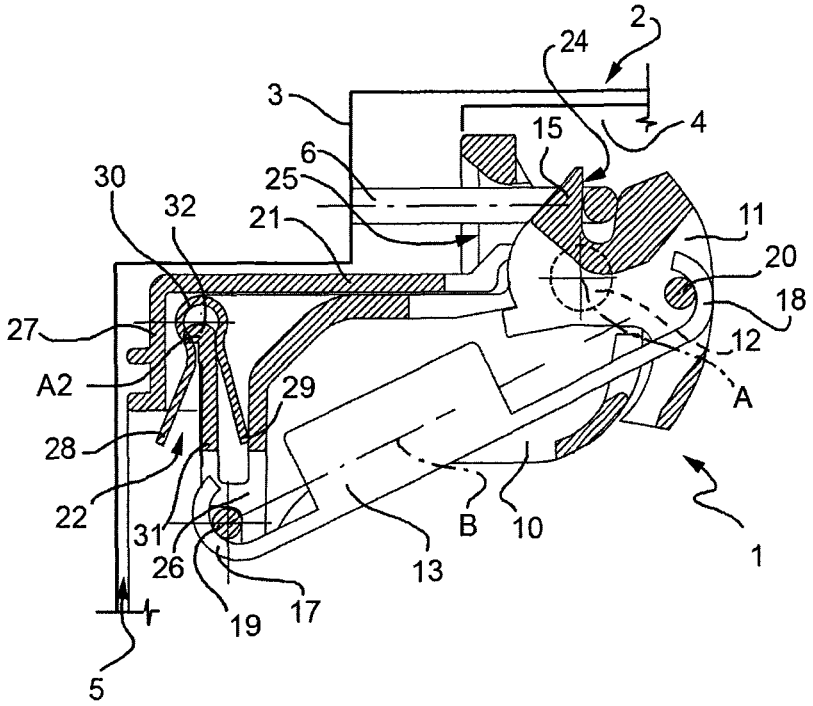
FIG. 1 diagrammatically shows an elevation view of a self-resettable door locking device for an electric household appliance made according to the invention, shown in the normal locking configuration, with the door of the electric household appliance being closed.

With reference to FIG. 1, numeral 1 indicates as a whole a self-resettable door locking device for an electric household appliance 2, in particular a dishwasher, of which only the upper front portion of a frame 3 and of an upper edge of a door 4 for closing an access compartment, typically a washing chamber or tank, delimited by frame 3, are shown for simplicity. The latter carries in a known manner at the upper edge of the access compartment 5 a door catch 6, defined by a U-shaped bracket, acting in use as a striker for the door locking device 1 as described in greater detail below.

Figure 3:
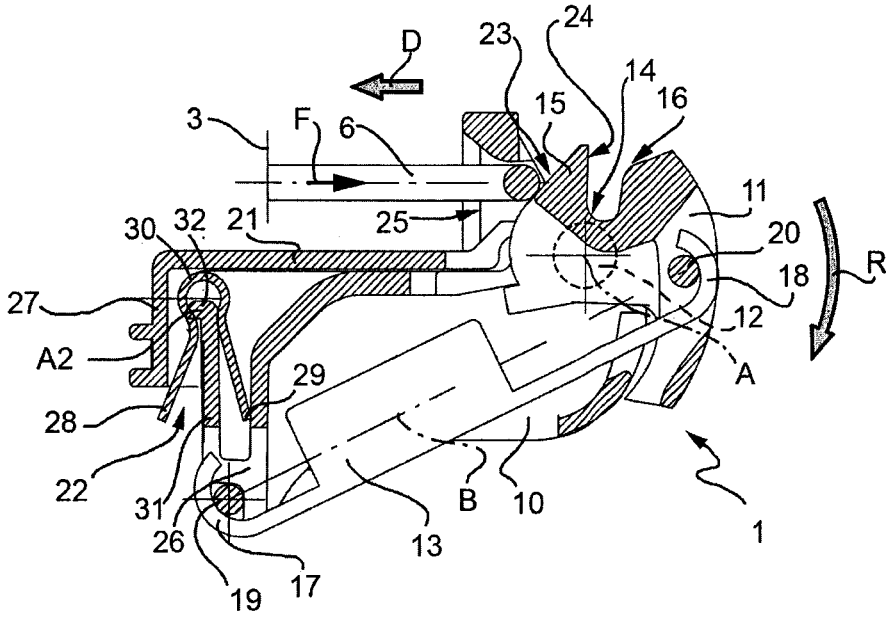
FIGS. 3 and 4 diagrammatically show the steps by means of which the device is reset to the normal locking configuration with the door closed as per in FIG. 1.
Figure 4:
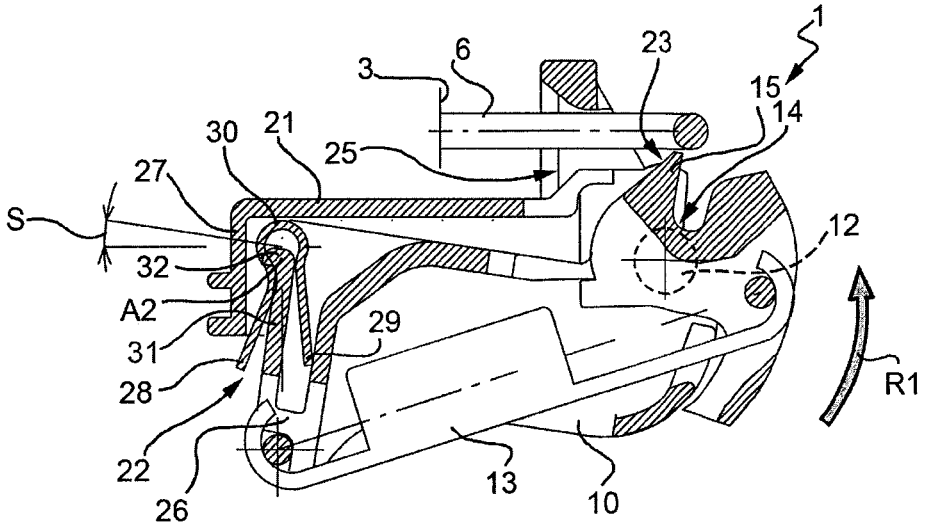
Figure 5:
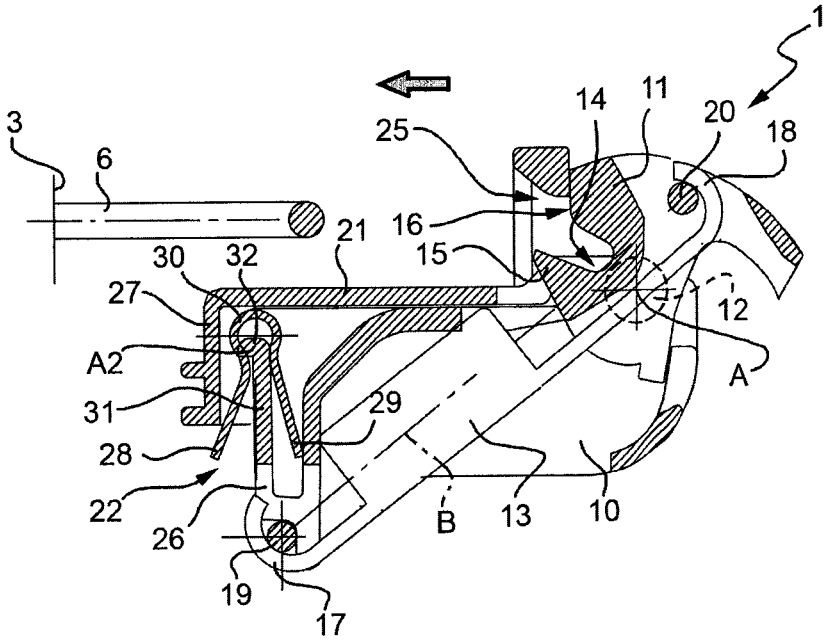
FIGS. 5 and 6 diagrammatically show instead the steps of normal operation of the device in FIG. 1.
Figure 6:
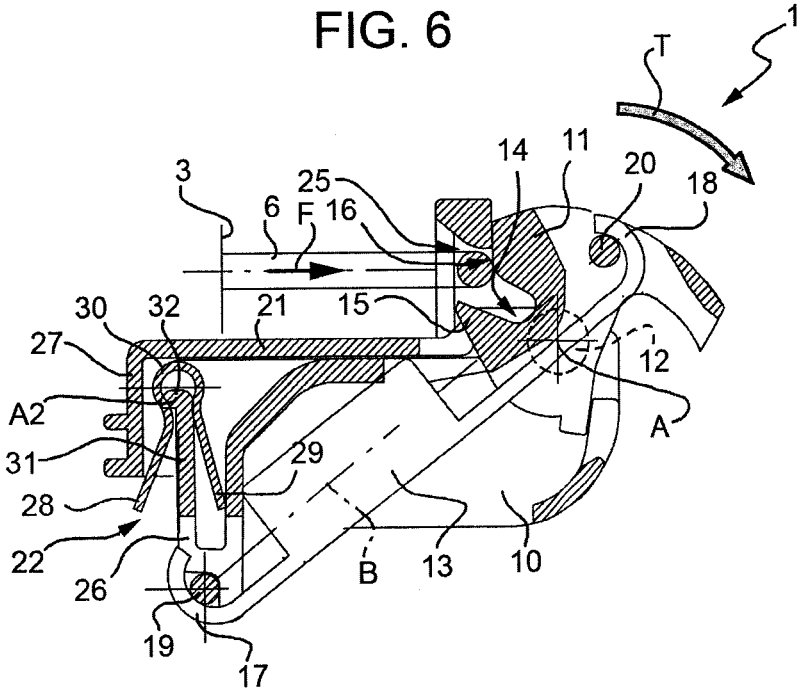

With reference to the remaining figures from 2 to 6, where for simplicity only device 1 is shown in its various possible working configurations with regards to the electric household appliance 2 and the door catch 6 is shown for reference, device 1 comprises a first supporting body 10, a latch 11 pivotally carried by the first supporting body 10 about a first rotation axis A defined by a rotation pin 12 of the latch 11, idly engaged in a known manner on body 10, and operatively associated in use with the door catch 6 of the electric household appliance 2, and first elastic means 13 secured to and interposed between the first supporting body 10 and the latch 11 to be adapted in use to make the latch 11 selectively take a first working position, shown in FIGS. 1, 2, 3 and 4, and a second working position, shown in FIGS. 5 and 6, rotated to each other by a first angle of about 90° or a fraction smaller than 90°, about the first axis A.

Latch 11 is a substantially fork-shaped plate on a plane perpendicular to the rotation axis A, and has a compartment 14 (FIG. 2) for receiving the door catch 6 delimited between a tooth 15 and a shoulder edge 16 of the latch 11; the latter is made of a moulded, synthetic plastic material.

The elastic means 13 are defined by a helical spring (known and diagrammatically shown only with regards to its outer dimensions) ending with two opposite ends 17,18 which, after a straight length, end in turn with a hook-shaped part to engage respective pins 19,20 carried by the body 10 and, in an eccentric position with respect to axis A, by the catch 11, respectively, both the pins being arranged parallel to axis A.

Pins 19 and 20 are further arranged transversally through an axis B perpendicular to axis A and along which the pins 19,20 are in use aligned with each other; in the steady working positions of device 1, axis B is in use always eccentrically shifted with respect to axis A so as to be, in the two mentioned working positions of the latch 11, either under (FIGS. 1-4) or over (FIGS. 5,6) the pin 12, respectively, so that latch 11 with spring 13 and body 10 define a bistable mechanism, in which latch 11 may pass from the first to the second working position, and vice versa, due to a simple thrust exerted thereon, in particular on shoulder 16 or tooth 15, eccentric with respect to axis A, so as to create a torque which opposes that generated in use by the spring 13, which is however mounted so as to be preloaded between the pins 19 and 20, according to a known configuration.

According to the main feature of the invention, device 1 further comprises a second supporting body 21 designed to be integrally carried in use by the door 4 of the electric household appliance 2 and which movably supports the body 10, and second elastic means 22 carried by the second body 21 and interposed between the latter and the first body 10; the supporting bodies 10 and 21 are both made by moulding a synthetic plastic resin. Furthermore, body 10 is normally kept by the elastic means 22 in a first working position shown in FIGS. 1, 2, 3, 5 and 6, where the tooth 15 of the latch 11 is adapted to either intercept or not intercept the door catch 6 in use, respectively, according to whether the latch 11 is in the first or second working position, respectively, in which it either locks or releases the door 4, respectively, when this is in the closed position, shown in FIG. 1, at the access compartment 5.

Furthermore, according to the invention, the first body 10 is movable relatively to the body 21 and against the bias of the elastic means 22 towards a second working position, shown in FIG. 4, in which the tooth of the latch 11 is no longer adapted in use to intercept the door catch 6 when the latch 11 is in the first working position.

In particular, according to one of the features of the invention, tooth 15 is delimited between a first side 23 thereof (FIGS. 3, 4) facing towards the body 21 and a second side 24 thereof (FIGS. 1, 2) facing the opposite side of the body 21.

Figure 2:
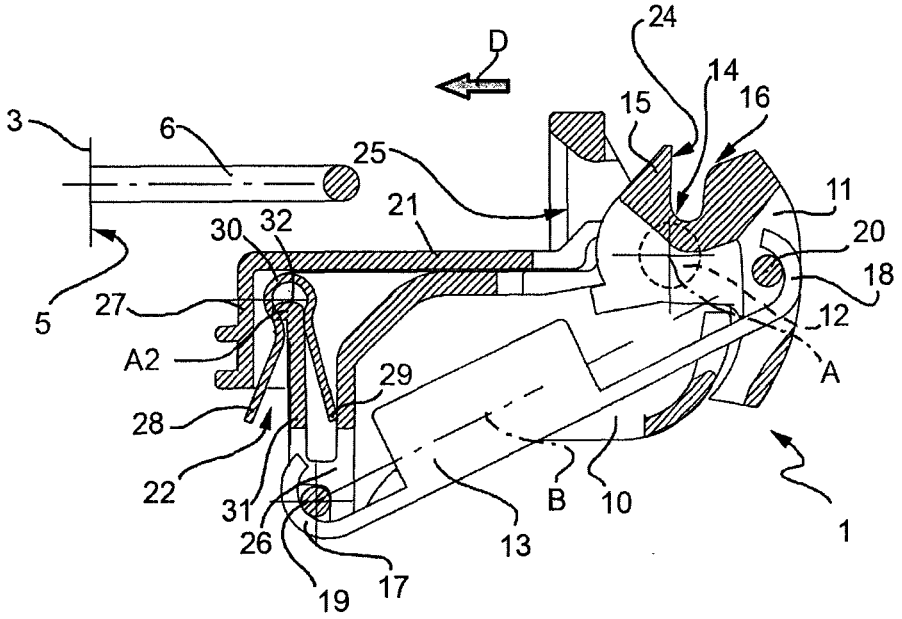
FIG. 2 diagrammatically shows an elevation view of the device in FIG. 1 in an open door situation but with the device in an anomalous configuration, i.e. in the same locking configuration as in FIG. 1.

The side 23 is shaped so that, in use, upon a movement of the door 4 in a direction D (FIGS. 2, 3) towards the closed position of FIG. 1, for example from an open position, away from the access compartment 5, like that shown in FIGS. 2 and 5, and when the latch 11 is in the first working position (FIGS. 2 and 3), the latch 11 is adapted to exert a thrust on the body 10, upon the interception of the door catch 6 by the side 23 itself, so as to take the body 10 to the second working position in FIG. 4, against the bias of elastic means 22 and without stressing the elastic means 21, thus rotating it in a direction R (FIG. 3), so that the latch 11 (FIG. 4) may pass the door catch 6 and allow the door 4 to reach the closed position, in which the door catch 6 is beyond the second side 24 of tooth 15.

On the other hand, side 24 is shaped so that the second elastic means 22 may return the first body 10 to the first, starting working position, by rotating it in direction R1 (FIG. 4), upon the insertion of the door catch 6 into compartment 14.

In the first working position of body 10, the latch 11 is arranged facing a seat 25 of body 21 adapted to receive in use the door catch 6, as shown in greater detail in FIGS. 1, 3, 4 and 6, while in the second working position of body 10, the latch 11 is at least partially away from the seat 25 for receiving the door catch 6 (FIG. 4).

In particular, the first body 10 is overhangingly hinged to the second body 21 on the side opposite to the latch 11 and so as to be able to rotate about a second axis A2 parallel to axis A.

According to one of the features of the invention, the bodies 10 and 21 are hinged to each other at respective first ends 26,27 thereof, which are opposite to the latch 11 and substantially L-shaped, arranged facing each other. In combination, the second elastic means 22 consist in a substantially V-shaped spring comprising a first overhanging arm 28 and a second overhanging arm 29, jointed together by an eyelet-like portion 30; spring 22 is simply inserted so as to be preloaded between the first facing L-shaped ends 26,27 of the first and second bodies 10,21, respectively.

The first body 10 has an appendix 31 at its first end 26, which overhangingly protrudes from the first end 26 so as to form a U-shaped bend therewith and which ends with an enlarged, toe-shaped free end 32, snappingly engaged within the eyelet-like portion 30 of the V-shaped spring 22. By means of the toe-shaped end 32, the first body 10 is hinged to the second body 21, pivoting about the second axis A2, which is defined in this case by the eyelet-like portion 30 of spring 22.

Thereby, the second elastic means 22 are adapted to allow a relative rotation about the second axis A2 between the first body 10 and the second body 21 to take place, which rotation is eccentric with respect to the latch 11 and to the first axis A. In order to promote both this rotation and the assembly of body 10 on body 21, the appendix 31 of the end 26 of body 10 is at least partially elastic, which is allowed by the body 10 consisting of a single piece of synthetic plastic material.

According to the above description, it is apparent that the latch 11, if in the first working position, may perform an eccentric rotation about the second axis A2 against the bias of the second elastic means 22, in response to a movement of the door 4 towards the closed position (movement in direction D) and the consequent interception, in use, of the door catch 6 by the latch 11, to "skip" the door catch 6 itself (FIG. 4); whilst, when the latch 11 is in the second working position, upon the movement of the door 4 in the direction D towards the closed position, it abuts against the door catch 6 (FIG. 6), but in an eccentric position with respect to the first axis A, so as to overcome the resistance of the elastic means 13 and thus producing a temporary instability, which causes the elastic means 13 to rotate the latch 11 from the second to the first working position, thus moving the relative position of axis B with respect to the pin 12.

Thus, when there are no anomalies, device 10 works in the "traditional" manner, shown in FIGS. 5 and 6. When the door 4 is open (FIG. 5), the latch 11 is in the second working position with the compartment 14 facing towards the door catch 6 and substantially facing the same; by taking the door 4 within the door compartment 5, the shoulder edge 16 of the latch 11 abuts against the door catch 6, which in the meantime has penetrated into the seat 25, thus exerting a reaction force F on the latch 11 (FIG. 6), which is eccentric with respect to axis A; therefore it applies a torque on the latch 11, which forces it to make a rotation T (FIG. 6), which stresses the spring 13 by pulling it and starts moving the axis B with respect to the pin 12; about half way, the elastic reaction of the spring 12 completes the rotation of the latch 11, taking it to the first working position, thus causing the engagement of the door catch 6 in the compartment 14 (FIG. 1); in this position, door 4 is closed and locked because the tooth 15 intercepts the door catch 6 by its side 24.

In order to open the door 4, it is sufficient for the user to exert a traction thereon, in the sense of moving it away from the door compartment 5 (i.e. in direction D, but in the opposite way); in this case, the side 24 of tooth 15 receives a thrust from the door catch 6, which produces a rotation of the latch 11 in the direction opposite to the previous one, towards the second working position, in which the door catch 6 is disengaged. The latch 11 is again in the position in FIG. 5 and the device 1 is ready for another closing manoeuvre.

If the latch 11 is manually taken to the working position by mistake, or if an anomalous operation of the bistable mechanism defined by latch 11, spring 13 and body 10 occurs, the situation shown in FIGS. 2 and 3 may occur; in this case, the door 4 could not be closed with a traditional door locking device; indeed, by approaching the door 4 to the door compartment 5, the tooth 15 abuts against the door catch 6 by its side 23, by means of which the latch 11 receives the reaction force F (FIG. 3), but it may not rotate in direction R as it is already in end-of-travel position.

According to the invention, the force F is instead eccentrically directed to axis A2, whereby it exerts a torque on the latch 11, which torque is transmitted to the body 10 to which it is secured by means of the pin 12, since the latch 11 is not able to rotate; the body 10 is thus urged to rotate in direction R, which is possible against the action of spring 22 as it is movable (hinged), according to the invention, to the body 21, instead of being fixed to the door 4.

Therefore, body 10 rotates by an angle S (FIG. 4) by lowering the latch 11 under the door catch 6; in this position, the tooth 15 may no longer intercept the door catch 6, whereby door 4 may be normally closed; the elastic reaction of the spring 22 thus returns the body 10 to the starting position, rotating it in direction R1 (FIG. 4), as soon as the tooth 15 moves away from the door catch 6, thus producing the insertion of the latter into the compartment 14 because the latch 11 was and continues to be in the first working position. The normal closed position in FIG. 1 is thus obtained again, despite the initial starting anomaly.

The invention claimed is:

1. A self-resettable door locking device for an electric household appliance, the self-resettable door locking device comprising:

a second supporting body configured to be integrally carried in use by a door of the electric household appliance;

a first supporting body which is movably supported by the second supporting body;

a latch pivotally carried by the first supporting body about a first rotation axis and operatively associated in use with a door catch of the electric household appliance and first elastic means secured to and interposed between the first supporting body and the latch to be adapted in use to make the latch selectively take first and second latch working positions, the second latch working position being a position of the latch corresponding to rotation of the latch away from the first latch working position by a first angle about the first axis;

and second elastic means carried by the second supporting body and interposed between the latter and the first supporting body;

wherein the first supporting body is normally kept by the second elastic means in a first working position of the first supporting body, in which a tooth of the latch is adapted to intercept/not intercept in use the door catch when the latch is in said first and second latch working positions, respectively, to respectively block/release the door when it is in a closed position, wherein the first supporting body is movable against the bias of the second elastic means towards a second working position of the first supporting body, in which the tooth of the latch is no longer adapted to intercept in use the door catch when the latch is in said first latch working position, and wherein in the first working position of the first supporting body, the latch is facing a seat of the second supporting body adapted to receive in use the door catch, whereas in the second working position of the first supporting body the latch is at least partially removed from said seat for receiving the door catch.

2. A device according to claim 1, characterized in that a first side of said tooth of the latch, facing the second body, is shaped so that upon a movement of the door towards the closed position and when the latch is in said first working position, the latch exerts on the first body, upon the interception of the door catch by said first side of the latch tooth, a thrust such as to take, against the bias of the second elastic means and without stressing the first elastic means, the first body to said second working position, so that the latch may pass the door catch and allow the door to reach the closed position, in which the door catch]is beyond a second side of said tooth of the latch, facing the side opposite to the second body and shaped so that the second elastic means may return the first body to the first working position.

3. A device according to claim 1, characterized in that said first body is overhangingly hinged to the second body on the side opposite to the latch and so as to be able to rotate about a second axis parallel to the first.

4. A device according to claim 3, characterized in that the latch, when it is in said first working position, may perform against the bias of the second elastic means and along with the first body, an eccentric rotation about the second axis upon a movement of the door towards the closed position and the consequent interception in use of the door catch by the latch, to skip the door catch; whereas, when it is in the second working position, upon a movement of the towards the closed position, the latch abuts against the door catch, but in an eccentric position with respect to the first axis, so as to cause the first elastic means to rotate the latch from the second to the first working position.

5. A device according to claim 3, characterized in that said second elastic means are adapted to allow a relative eccentric rotation between the first and second bodies about said second axis with respect to the latch and to the first axis.

6. A device according to claim 1, characterized in that said first and second bodies are hinged to each other at respective first ends thereof opposite to the latch and substantially L-shaped, arranged facing each other; said second elastic means consisting in a substantially V-shaped spring, comprising first and second overhanging arms, jointed together by an eyelet-like portion, simply preloaded and inserted between the first facing L-shaped ends of the first and second bodies, the first body having at its first end an appendix which overhangingly protrudes from the first end so as to form a U-shaped bend therewith and which ends with an enlarged, toe-shaped free end, snappingly engaged within the eyelet-like portion of the V-shaped spring and by means of which the first body is hinged to the second, pivoting about the second axis, which is defined by said eyelet-like portion of the spring.

7. A device according to claim 6, characterized in that said appendix of the first end of the first body is at least partially elastic.

8. A device according to claim 1, characterized in that said first and second bodies and said latch are made of a molded synthetic plastic material.

9. A device according to claim 1, characterized in that the first axis is defined by a rotation pin of the latch, idly engaged on the first body.

10. An apparatus, comprising:

a household appliance including the door locking device of claim 1.

11. An apparatus, comprising:

a dishwasher including the door locking device of claim 1.

12. A device according to claim 1, characterized in that the device is configured such that, in use, upon a movement of the door in a direction towards closed position from an open position, and when the latch is in the first latch working position, the latch exerts a thrust on the first body, upon interception of the door catch by a side of the latch, so as to drive the first body from the first working position of the first body to the second working position of the first body, against the bias of the second elastic means and without stressing the first elastic means.

13. A self-resettable door locking device for an electric household appliance, the self-resettable door locking device comprising:

a second supporting body configured to be integrally carried in use by a door of the electric household appliance;

a first supporting body which is movably supported by the second supporting body;

a latch pivotally carried by the first supporting body about a first rotation axis and configured to be operatively associated in use with a door catch of the electric household appliance;

first elastic means secured to and interposed between the first supporting body and the latch adapted in use to make the latch selectively take first and second latch working positions, the second latch working position being a position of the latch corresponding to rotation of the latch away from the first latch working position by a first angle about the first axis;

and second elastic means carried by the second supporting body and interposed between the second supporting body and the first supporting body, wherein the self-resettable door locking device is configured such that the first supporting body is normally kept by the second elastic means in a first working position of the first supporting body, in which a tooth of the latch is adapted to respectively (i) intercept and (ii) not intercept in use the door catch when the latch is in said first and second latch working positions, respectively, to respectively (iii) block and (iv) release the door when it is in a closed position, and the first supporting body is movable against the bias of the second elastic means towards a second working position of the first supporting body, in which the tooth of the latch is no longer adapted to intercept in use the door catch when the latch is in said first latch working position; wherein in said first working position of the first body, the latch is facing a seat of the second body adapted in use to receive the door catch, wherein in the second working position of the first body the latch is at least partially removed from said seat for receiving the door catch.

14. A self-resettable door locking device of claim 13, wherein:

the appliance is a dishwasher.

15. An apparatus, comprising:

a household appliance including the door locking device of claim 13.

16. The apparatus of claim 15, wherein:

the household appliance is a dishwasher.

17. The apparatus of claim 13, wherein:

the self-resettable door locking device is configured such that the latch toggles between the first and second latch working positions of the latch.

18. The apparatus of claim 13, wherein:

the apparatus is configured such that the first elastic means is stretched by a greater amount than that which is the case when the latch takes the first latch working position and when the latch takes the second latch working position.

19. The apparatus of claim 13, wherein:

the apparatus is configured such that the first body is movable from the first working position of the first body to the second working position of the first body without stressing the first elastic means.

20. An assembly, comprising:

a self-resettable door locking device configured to self-resettably lock a door of an electric household appliance, the self-resettable door locking device comprising:

a first supporting body;

a latch pivotally carried by the first supporting body about a first rotation axis and configured to be operatively associated in use, when attached to the electric household appliance, with a door catch of the electric household appliance;

first elastic component secured to and interposed between the first supporting body and the latch, wherein the self-resettable door locking device is configured such that the latch selectively takes first and second latch working positions, the second latch working position being a position of the latch corresponding to rotation of the latch away from the first position by a first angle about the first axis;

a second supporting body configured to be integrally carried in use by a door of the electric household appliance and which movably supports the first body; and second elastic component carried by the second supporting body and interposed between the second supporting body and the first supporting body, wherein the self-resettable door locking device is configured such that the first supporting body is normally kept by the second elastic means in a first first supporting body working position, in which a tooth of the latch is adapted to, when the self-resettable door locking device is attached to the electric household appliance, respectively (i) intercept and (ii) not intercept in use the door catch when the latch is in said first and second latch working positions, respectively, to respectively (iii) block and (iv) release the door when it is in a closed position, and the first supporting body is movable against the bias of the second elastic means towards a second first supporting body working position, in which the tooth of the latch is no longer adapted to intercept in use the door catch when the latch is in said first latch working position and the self-resettable door locking device is attached to the electric household appliance; wherein in said first working position of the first body, the latch is facing a seat of the second body adapted in use to receive the door catch, wherein in the second working position of the first body the latch is at least partially removed from said seat for receiving the door catch.

21. A self-resettable door locking device of claim 20, wherein:

the appliance is a dishwasher.

22. An apparatus, comprising:

a household appliance including the door locking device of claim 20.

23. The apparatus of claim 22, wherein:

the second first supporting body working position of the first body is a position in which the latch is completely below the lowest point of a component of the door catch that, in use, contacts the latch when the first body is in the first working position.

24. The apparatus of claim 22, wherein:

the household appliance is a dishwasher.

25. The apparatus of claim 20, wherein:

the assembly is configured such that the first elastic component alternatingly biases the latch in the first latch working position of the latch and the second latch working position of the latch.

26. The apparatus of claim 20, wherein:

the second first supporting body working position of the first body is a position in which the latch cannot contact the door catch.

27. The assembly according to claim 20, wherein in said first first body working position of the first body, the latch is facing a seat of the second body adapted to receive in use the door catch, whereas in the second first body working position of the first body the latch is at least partially removed from said seat for receiving the door catch.

28. An assembly, comprising:

a self-resettable door locking device configured to self-resettably lock a door of an electric household appliance, the self-resettable door locking device comprising:

a first supporting body movably supported by a second supporting body;

a latch pivotally carried by the first supporting body about a first rotation axis and configured to be operatively associated in use, when attached to the electric household appliance, with a door catch of the electric household appliance, wherein the assembly is configured such that the latch is toggled between first and second latch working positions, the second latch working position being a position of the latch corresponding to rotation of the latch away from the first latch working position by a first angle about the first axis;

the second supporting body, wherein the second supporting body is configured to be carried in use by a door of the electric household appliance;

wherein the self-resettable door locking device is configured such that the first supporting body is normally kept in a first first supporting body working position, in which a tooth of the latch is adapted to, when the self-resettable door locking device is attached to the electric household appliance, respectively (i) intercept and (ii) not intercept in use the door catch when the latch is in said first and second latch working positions, respectively, to respectively (iii) block and (iv) release the door when it is in a closed position, and wherein the first supporting body is movable towards a second first supporting body working position, in which the tooth of the latch is no longer adapted to intercept in use the door catch when the latch is in said first latch working position and the self-resettable door locking device is attached to the electric household appliance; wherein in said first working position of the first body, the latch is facing a seat of the second body adapted in use to receive the door catch, wherein in the second working position of the first body the latch is at least partially removed from said seat for receiving the door catch.

29. The apparatus of claim 28, wherein:

the apparatus is configured such that the first body toggles between the first first supporting body working position of the first body and the second first supporting body working position of the first body.

30. The assembly according to claim 28, wherein in said first first body working position of the first body, the latch is facing a seat of the second body adapted to receive in use the door catch, whereas in the second first body working position of the first body the latch is at least partially removed from said seat for receiving the door catch.

* * * * *